United States Patent [19]

Steen

[11] Patent Number: 4,534,399

[45] Date of Patent: Aug. 13, 1985

[54] PAPER STOCK DIFFUSER SYSTEM

[75] Inventor: Conrad Steen, Vancouver, Wash.

[73] Assignee: Crown Zellerbach Corporation, San Francisco, Calif.

[21] Appl. No.: 625,278

[22] Filed: Jun. 27, 1984

[51] Int. Cl.[3] ..... D21F 1/02

[52] U.S. Cl. ..... 162/212; 162/336; 162/343; 162/380; 239/499; 239/589

[58] Field of Search ..... 162/212, 216, 336, 343, 162/344, 380; 239/499, 589, 601

[56] References Cited

U.S. PATENT DOCUMENTS

| | | | |
|---|---|---|---|
| 2,688,276 | 9/1954 | Showers | 162/343 |
| 3,562,107 | 2/1971 | Schmaeng | 162/336 |
| 3,725,197 | 4/1973 | Dahl et al. | 162/343 |
| 4,055,306 | 10/1977 | Hruby | 239/601 |
| 4,455,197 | 6/1984 | Croteau et al. | 162/343 |

*Primary Examiner*—S. Leon Bashore
*Assistant Examiner*—Andrew J. Anderson
*Attorney, Agent, or Firm*—Thomas R. Lampe

[57] ABSTRACT

A paper stock diffuser system employing a plurality of spaced, generally V-shaped projections having adjoining shear surfaces diverging away from one another.

10 Claims, 6 Drawing Figures

PAPER STOCK DIFFUSER SYSTEM

BACKGROUND OF THE INVENTION

This invention relates to a system for establishing uniform distribution of fibers in a stock slurry prior to delivery of the stock to a forming surface of a papermaking machine.

It is highly important that paper stock when delivered to a paper forming surface be free of clumps, flocs, or agglomerations which can result in undesirable localized irregularities in the formed product, such as streaking and non-uniform density or thickness.

Numerous arrangements have been employed in the prior art in an attempt to obtain a generally uniform cross machine profile of deposited stock on the forming surface. Such prior attempts have included the use of complicated auxilliary equipment in the pre-slice area prior to deposition of the stock on the forming surface, such as rectifier rolls, holey rolls and other mechanical vibrating, shaking and stirring devices, all of which are characterized by their complexity of construction and high expense.

Another commonly used expedient employed to obtain uniform distribution of the stock material prior to entering a slice has been the use of multiple conduits or tubes for the stock positioned between the head box per se and the slice opening. Such arrangements attempt to obtain formation of a sheet of uniform thickness and density by breaking the stock proceeding from the head box down into separate stock flows and then recombining the flows. The theory behind such separate flow channels is that they facilitate stock mixing without impeding the smooth flow of the stock toward the slice opening. Such arrangements have the further advantage of employing only nonmovable or fixed elements, thus making them more reliable and less expensive than movable agitators or the like.

U.S. Pat. No. 2,688,276, issued Sept. 7, 1954 illustrates an example of a multi-tube arrangement employed to mix stock prior to its deposition on a forming surface. Several embodiments are illustrated in such patent including one wherein the tubes have deep serrations or V-cuts and sharpened edges at the downstream ends. Such a configuration is alleged in the patent to minimize disturbance of the forwardly flowing stock as it leaves the ducts or tubes.

Another multi-conduit configuration is illustrated in U.S. Pat. No. 3,725,197 wherein stock is flowed through a plurality of ducts, each of which progressively increases in diameter in the direction of stock flow in a series of steps. Successive different diameter portions of the ducts have a uniform cross section over the length thereof, and transition between two successive portions of the ducts has an opening angle of at least 100°, and preferably may be 180°.

Other representative patents illustrating usage of a plurality of stock flow tubes are U.S. Pat. Nos. 2,347,130, 3,238,236, 3,328,237, 3,400,044 and 3,846,229.

SUMMARY OF THE INVENTION

The present invention also relates to a multi-conduit system for mixing paper slurry as it is delivered to a slice opening. According to the present invention, the conduits have discharge end sections of a special construction which create a high degree of turbulence in the slurry as it exits from the conduits, thus resulting in effective deflocing and deagglomeration of the slurry.

This is accomplished by passing the stock past consecutive shear zones which create varied shear conditions. While passing through the shear zones the stock flow is diverted radially outwardly along shear surfaces which diverge at increasing angles and progressively diminish in size until they form an open area whereat the stock flow completely exits from the conduit into a stock flow passageway terminating at the slice opening.

DESCRIPTION OF THE DRAWINGS

Other characteristics of the invention will be apparent from the following more detailed description and accompanying drawings in which.

DETAILED DESCRIPTION

Figure 1:
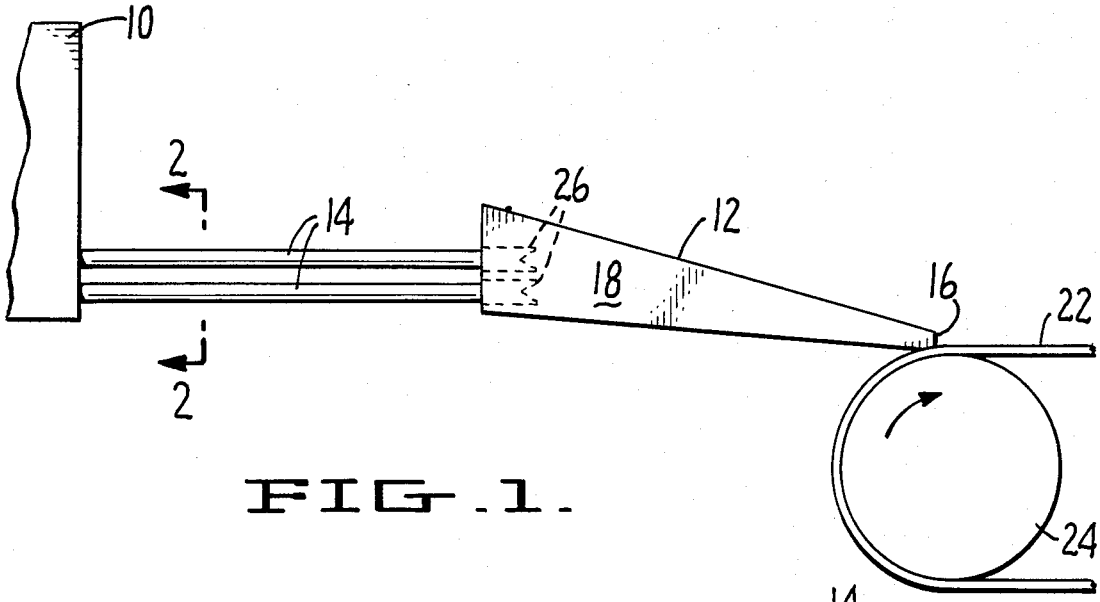
FIG. 1 is a schematic side sectional view of apparatus constructed in accordance with the teachings of the present invention.
Figure 2:
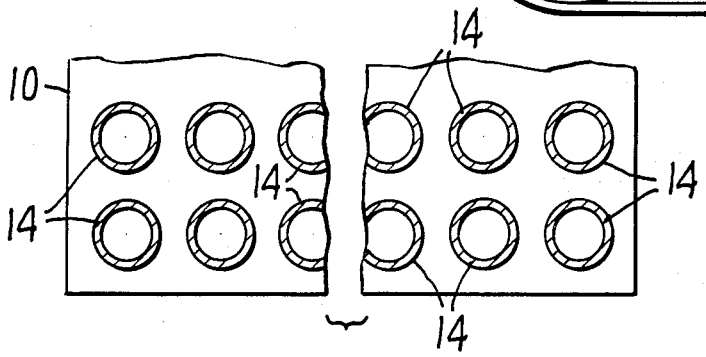
FIG. 2 is an enlarged cross sectional view taken along the line 2—2 in FIG. 1.
Figure 3:
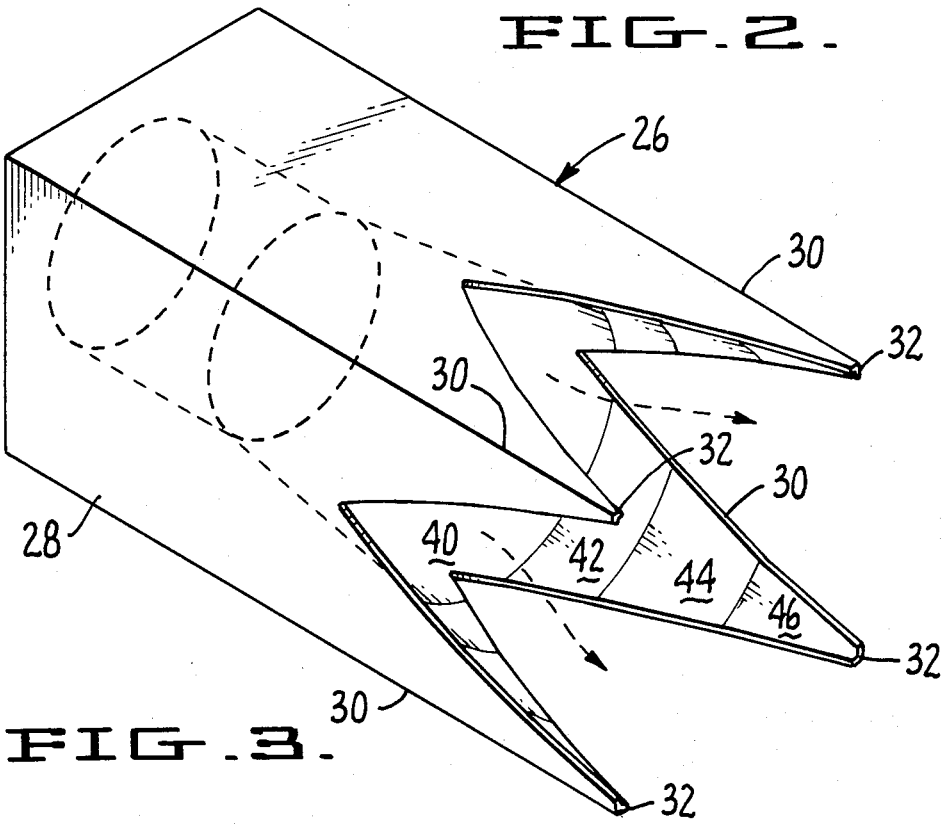
FIG. 3 is an isometric view of a single discharge end section constructed in accordance with the teachings of the present invention.
Figure 4:
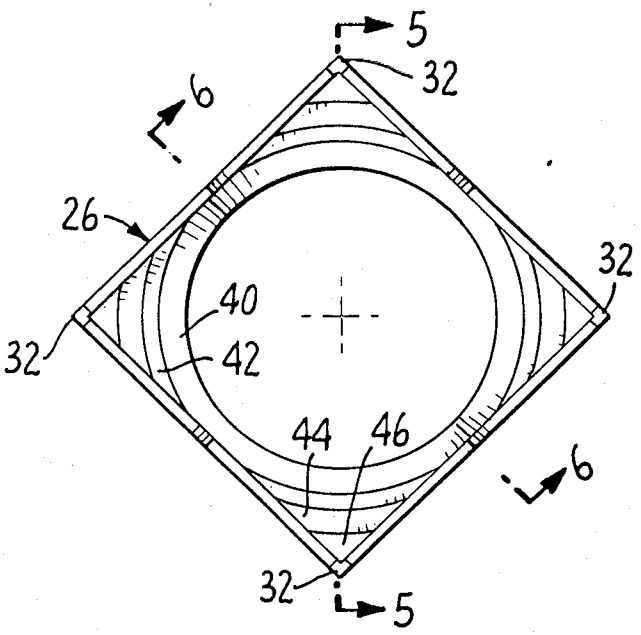
FIG. 4 is an end view of the discharge end section.
Figure 5:
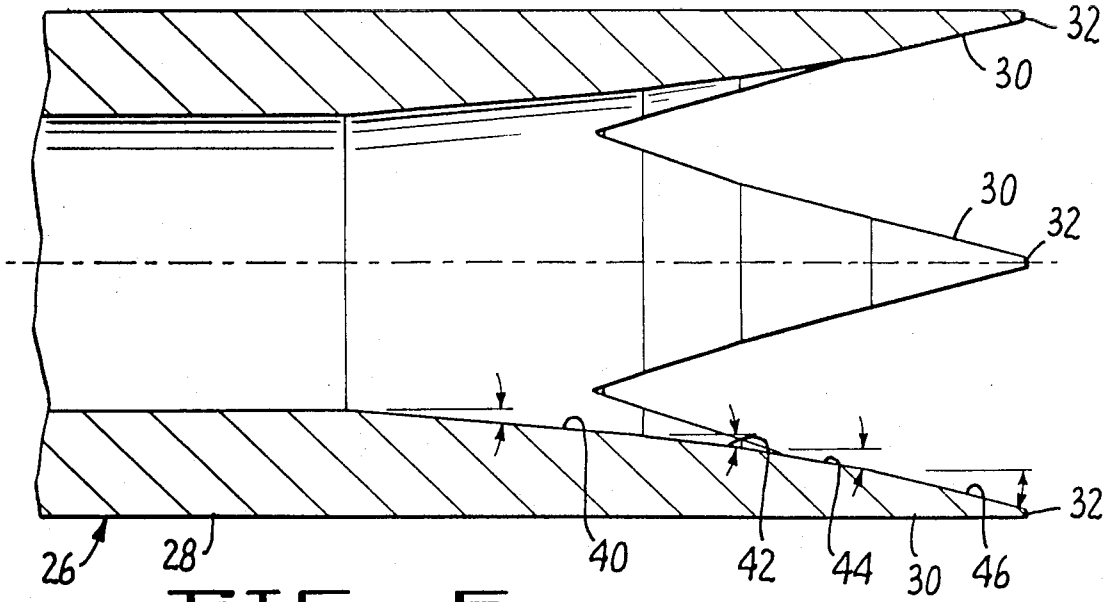
FIG. 5 is a cross sectional view taken along the line 5—5 of FIG. 4.
Figure 6:
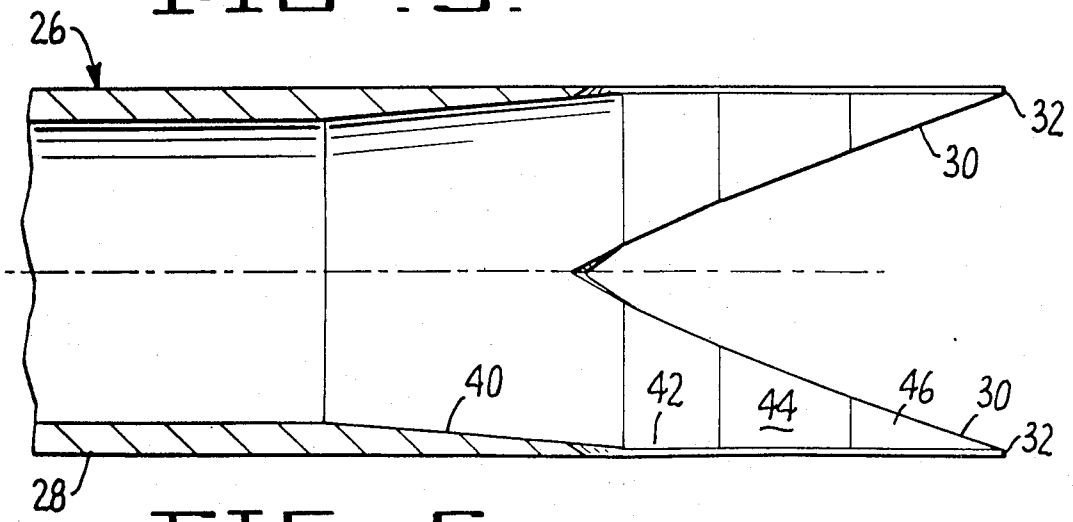
FIG. 6 is a cross sectional view taken along the line 6—6 of FIG. 4.

FIG. 1 illustrates in simplified schematic fashion a typical papermaking machine layout incorporating the teachings of the present invention. A stock supply chamber or headbox 10 is provided to maintain in the interior thereof a supply of paper stock. Slice means 12 is spaced from the stock supply chamber and is adapted to receive stock from the chamber through a plurality of conduits 14 extending between the stock supply chamber and the slice means. The slice means forms a slice opening 16 communicating with the stock flow passageway 18 defined by the slide means. As may be seen with reference to FIG. 2, conduits 14 are disposed in superposed pairs across the widths of the chamber 10 and slice means 12.

As is conventional, paper stock exits through slice opening 16 and is deposited on a papermaking machine forming surface 22. The forming surface 22 may be of any suitable type. In the interest of simplicity, forming surface 22 in FIG. 1 is in the nature of a Fourdrinier wire disposed about rotating roll 24.

Paper stock exiting from the spaced stock flow paths defined by conduits 14 should be free of flocs and agglomerations prior to exiting slice opening 16 so that paper formed on wire 22 is uniform. The means for accomplishing this end are in the form of discharge end sections 26 forming a portion of conduits 14 at the downstream ends thereof. Discharge end sections 26 are positioned at the stock flow passageway 18.

The construction of a single representative discharge end section can best be seen with reference to FIGS. 3 through 6. The discharge end sections may be constructed by any suitable material such as stainless steel and each is adapted to be attached in any suitable manner to the remainder of the conduit. Each discharge end section 26 includes a main body portion 28 connected to the rest of the conduit and from which project a plurality of spaced, tapered projections 30. Projections 30 are generally V-shaped and extend from bases attached to main body portion 28 to apices 32. The stock flow passageway has a center line and projections 30 diverge away from one another and from the center line so that the apices 32 of the projections 30 are further apart than the bases of the projections. The projections at the apices form an open end section area, and the apices are preferably truncated but may come to a sharp point if desired.

The discharge end section defines a plurality of shear surfaces 40, 42, 44 and 46 radially disposed about the center line and extending seriatim along the lengths of projections 30 to the apices 32. The shear surfaces of each discharge end section diverge away from the center line thereof at increasing angles in the direction of the apices 32. In the illustrated preferred embodiment, the angle defined by shear surface 46 positioned at a projection apex and the center line is in the order of 13°; that defined by shear surface 44, 10°; that defined by shear surface 42, 7°; and that defined by shear surface 40, 5°. It should be noted that shear surface 40 extends into the discharge end section beyond the bases of the projections 30.

According to the method employing the disclosed apparatus, paper stock is directed through the conduits including the discharge end sections into the stock flow passageway 18 in an initial predetermined direction. Shear surfaces 40, 42, 44 and 46 cooperate with the flow to substantially simultaneously subject the flow to forces which peripherally spread the flow outwardly away from the predetermined direction in incremental angular steps, while subjecting the flow to variable shear forces which induce turbulence in the flow. It is these variable shear forces and the turbulence created thereby which promote the mixing of the paper stock and result in the desired deflocing and deagglomerating action. As the stock flow is diffused and diverges outwardly an increasing percentage thereof comes into contact with paper stock already in the stock flow passageway due to the V-shaped character of the projections 30, further promoting shear. At the same time, stock flowing within the confines of the projections is progressively diffused outwardly to a greater degree.

I claim:

1. Apparatus for supplying paper stock to a forming surface of a papermaking machine comprising, in combination:

a stock supply chamber defining an interior;

slice means spaced from said stock supply chamber, said slice means forming a slice opening and a stock flow passageway terminating at said slice opening; and a plurality of conduits extending between said stock supply chamber and said slice means, said conduits defining spaced stock flow paths providing communication between said stock supply chamber interior and said stock flow passageway and including discharge end sections positioned at said stock flow passageway, said discharge end sections each having a center line and including a plurality of spaced, generally V-shaped projections projecting into said stock flow passageway and positioned about a stock flow path, said projections diverging away from one another and from said center line so that the apices of the projections of each end section are further apart than the bases thereof, and said discharge end sections each defining a plurality of adjoining shear surfaces radially disposed about said center line and extending seriatim along the lengths of said projections to the apices thereof, the shear surfaces of each discharge end section diverging away from the center line thereof at increasing angles in the direction of the projection apices.

2. The apparatus of claim 1 wherein the angle defined by the shear surface positioned at a projection apex and the center line is in the order of 13°.

3. The apparatus of claim 1 wherein the angle defined by the shear surface positioned the maximum distance away from a projection apex and the center line is in the order of 5°.

4. The apparatus of claim 1 wherein each said discharge end section defines at least one shear surface extending into said discharge end section beyond the bases of the projections of the discharge end section.

5. Diffuser apparatus for placement at the end of a conduit conveying paper stock to slice means, said apparatus comprising a main body portion defining a passageway for communication with the conduit interior and having a center line, and a plurality of spaced, tapered projections projecting from bases connected to said main body portion and forming apices spaced from said bases, said projections diverging away from one another and from said center line so that the apices of the projections are further apart than the bases thereof, and tapered projections defining a plurality of adjoining shear surfaces radially disposed about said center line and extending seriatim along the lengths of said projections to the apices thereof, the shear surfaces diverging away from the center line at increasing angles in the direction of the projection apices.

6. The apparatus of claim 5 wherein the angle defined by the shear surface positioned at a projection apex and the center line is in the order of 13°.

7. The apparatus of claim 5 wherein said main body portion also at least partially defines at least one shear surface.

8. The apparatus of claim 5 wherein the angle defined by the shear surface positioned the maximum distance away from the projection apex and the center line is in the order of 5°.

9. A method of treating paper stock being delivered from a stock supply source to a stock flow passageway terminating at a slice opening, said method comprising the steps of:

establishing a plurality of separate flow paths having spaced center lines between said stock supply source and said stock flow passageway;

flowing said paper stock in said flow paths;

directing the paper stock from said flow paths into said stock flow passageway;

expanding said flow paths to provide a plurality of adjoining shear surfaces radially disposed about said center lines and diverging away from the center lines at progressively increasing angles;

flowing said paper stock along and in engagement with said adjoining shear surfaces whereby said paper stock in said flow paths diffuses and radiates outwardly away from said center lines in adjoining, consecutive, incremental angular steps; and simultaneously with the step of flowing said paper stock along and in engagement with said adjoining shear surfaces, gradually continuously increasing contact between the outer peripheral surface of said flowing paper stock and paper stock already in said stock flow passageway, whereby variable shear conditions are created and said flowing paper stock is defloced and deagglomerated.

10. The method of claim 9 wherein the paper stock in the flow paths radiates outwardly away from said center lines a maximum angle in the order of 13°.

* * * * *